US007029317B2

(12) United States Patent
Chen

(10) Patent No.: US 7,029,317 B2
(45) Date of Patent: Apr. 18, 2006

(54) ELECTRONIC APPARATUS HAVING AC INLET WITH HEAT INSULATION FUNCTION

(75) Inventor: Chun-Chen Chen, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/847,182

(22) Filed: May 17, 2004

(65) Prior Publication Data

US 2005/0042904 A1 Feb. 24, 2005

(30) Foreign Application Priority Data

Aug. 21, 2003 (TW) ..... 92123083 A

(51) Int. Cl.
*H01R 13/00* (2006.01)

(52) U.S. Cl. ..... 439/485; 439/206; 361/687; 361/688

(58) Field of Classification Search ..... 439/170, 439/166, 189, 205, 206, 485, 374; 361/687, 361/688; 376/283; 310/59
See application file for complete search history.

(56) References Cited

U.S. PATENT DOCUMENTS

| | | | | |
|---|---|---|---|---|
| 4,740,167 | A * | 4/1988 | Millhimes et al. | 439/92 |
| 4,911,649 | A * | 3/1990 | Helmich, Jr. | 439/170 |
| 5,648,712 | A * | 7/1997 | Hahn | 320/111 |
| 5,718,597 | A * | 2/1998 | Kodama | 439/374 |
| 5,823,815 | A * | 10/1998 | Takata | 439/374 |
| 5,898,130 | A * | 4/1999 | Tansi et al. | 174/66 |
| 6,319,068 | B1 * | 11/2001 | Bao | 439/660 |
| 6,347,949 | B1 * | 2/2002 | Edwards et al. | 439/170 |
| 6,575,776 | B1 * | 6/2003 | Conner et al. | 439/206 |
| 6,702,604 | B1 * | 3/2004 | Moscovitch | 439/374 |
| 6,765,787 | B1 * | 7/2004 | Beasley et al. | 361/641 |
| 6,821,135 | B1 * | 11/2004 | Martin | 439/144 |

* cited by examiner

*Primary Examiner*—Gary F. Paumen
(74) *Attorney, Agent, or Firm*—Madson & Austin

(57) ABSTRACT

An electronic apparatus having an AC inlet with heat insulation function is disclosed. The electronic apparatus includes a housing having an indentation portion, an AC inlet disposed into the indentation portion, and an engaging element disposed at the indentation portion and the AC inlet for fixing the AC inlet into the indentation portion of the housing. The depth and the width of the indentation portion are greater than those of the AC inlet, respectively. Therefore, an airflow channel is formed between the indentation portion and the AC inlet for flowing air therein.

11 Claims, 4 Drawing Sheets

ELECTRONIC APPARATUS HAVING AC INLET WITH HEAT INSULATION FUNCTION

FIELD OF THE INVENTION

The present invention relates to an AC inlet having heat insulation function, and more particularly to an AC inlet having heat insulation function for use in an adapter or a power supply.

BACKGROUND OF THE INVENTION

Generally, for adapting to AC cables with different specifications and sizes in various countries, an adapter usually includes an AC inlet for electrically connecting to other electronic apparatuses. According to international IC 320 standard safety temperature value, the operation temperature of the AC inlet of the adapter for connecting different AC cables of various countries should be lower than the standard such as 78° C. The adapter used in electronic products will consume partial electric power when being operated. Furthermore, along with the technology development of electronic products, more and more electric units are loaded on the printed circuit board inside the electronic product, resulting in increasing the integration of the electric units. Currently, the electric power for operating most adapters has increased to 100~200 Watts, even over 200 Watts. Since the Watt consumption increases, it is inevitably that the temperature of the whole adapter is increased due to the heat generated from adapter operation. It also increases the difficulty for solving the temperature problem of the AC inlet. It is necessary to consider the international standard safety temperature value of the AC inlet when the adapter is designed and manufactured. Therefore, for complying with the standard, the internal structure of adapter must improve the heat dissipating effect, for example the DC fan addition. However, it causes the cost increase and the structure change of the AC inlet.

Therefore, the purpose of the present invention is to develop an adapter having an AC inlet with heat insulation function for efficiently insulating the heat generated from the adapter to deal with the above problems encountered in the prior art.

SUMMARY OF THE INVENTION

An object of the present invention is to provide an AC inlet having heat insulation function for efficiently preventing from heat conduction from the electronic apparatus.

Another object of the present invention is to provide an AC inlet having heat insulation function for preventing the AC inlet from temperature increase to comply with the international standard.

According to an aspect of the present invention, there is provided an electronic apparatus having an AC inlet with heat insulation function. The electronic apparatus includes a housing having an indentation portion, an AC inlet disposed into the indentation portion, and an engaging element disposed at the indentation portion and the AC inlet for fixing the AC inlet into the indentation portion of the housing. The depth and the width of the indentation portion are greater than those of the AC inlet, respectively, thereby forming an airflow channel between the indentation portion and the AC inlet so as to flow air in the airflow channel.

In an embodiment, the AC inlet further comprises at least one conductive terminal disposed on a surface of the AC inlet.

In an embodiment, the AC inlet further comprises a conductive element. Preferably, the conductive element is a power cord or a pin. In addition, the indentation portion includes an opening for disposing the conductive element.

In an embodiment, the AC inlet further comprises an insulating element. A space exists between the insulating element and the AC inlet, and the space is filled with an insulating material.

In an embodiment, the engaging element includes a bolt and an opening correspondingly disposed at the indentation portion and the AC inlet. Preferably, the engaging element is a protruding block, an elastic strip, a buckle or a plastic strip. The engaging element further includes at least one hole for circulating air between the airflow channel and the outside of the housing.

In an embodiment, the electronic apparatus is a power supply or an adapter.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention provides an electronic apparatus having an AC inlet with heat insulation function. The AC inlet is accommodated in an indentation portion of the electronic apparatus. There is an airflow channel formed between the AC inlet and the indentation portion of the electronic apparatus, so as to introduce airflow into the airflow channel. Then, the heat generated from the internal circuit system of the electronic apparatus is insulated and cannot be conducted to the AC inlet. Hence, the over-temperature condition of the AC inlet can be avoided to comply with the international IC 320 standard. The present invention can be used in an adapter or a power supply. The following embodiments use an adapter as examples to describe the present invention more specifically.

Figure 1:
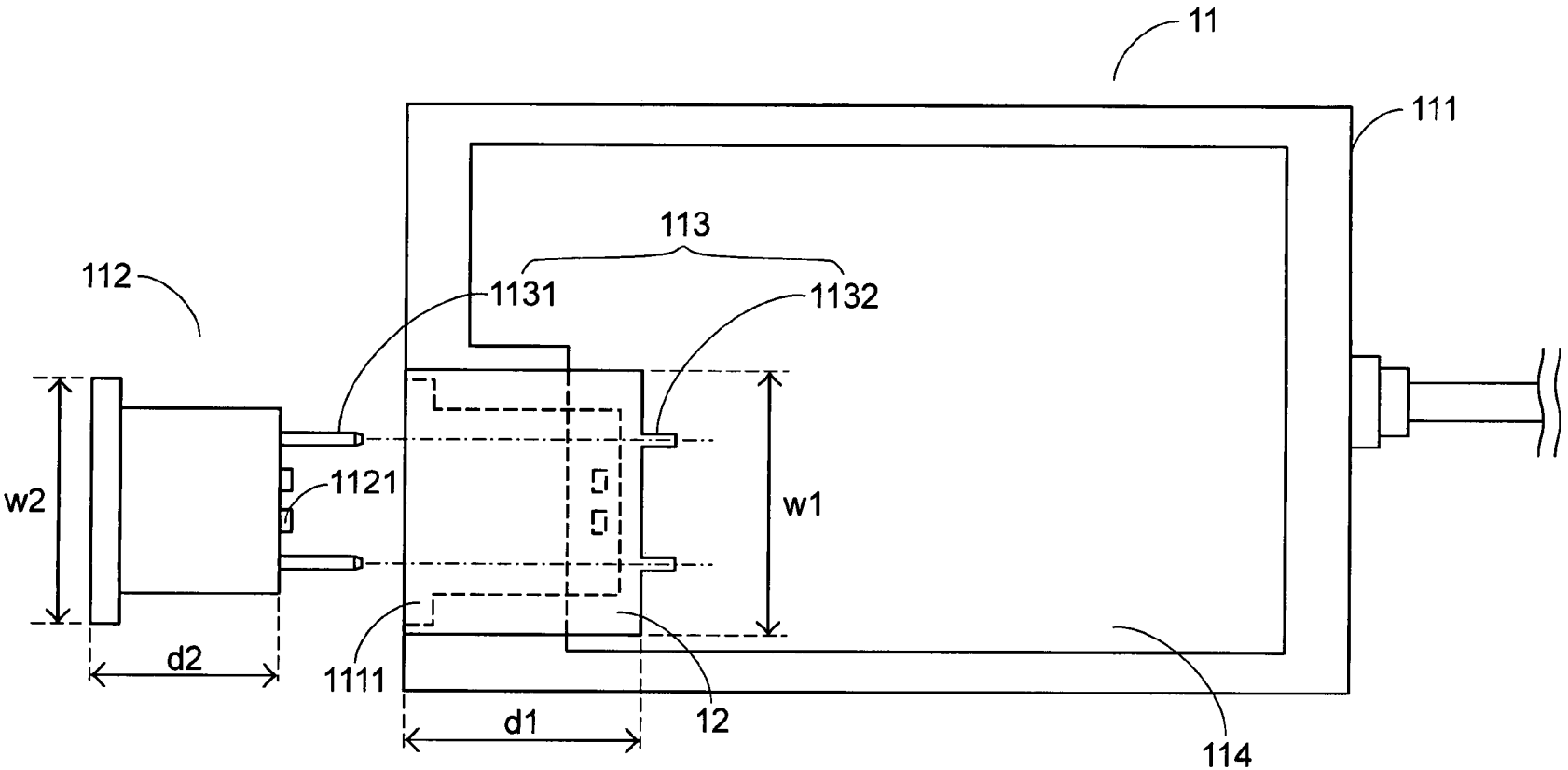
FIG. 1 is a diagram illustrating an electronic apparatus having an AC inlet with heat insulation function according to a preferred embodiment of the present invention.

Please refer to FIG. 1, which is a diagram illustrating an adapter having an AC inlet with heat insulation function according to a preferred embodiment of the present invention. As shown in FIG. 1, the adapter 11 includes a housing 111, an AC inlet 112 and an engaging element 113. The housing 111 includes an indentation portion 1111 for accommodating the AC inlet 112. The depth and the width of the indentation portion 1111 and the AC inlet are d1, w1 and d2, w2, respectively. As shown in FIG. 1, d1 and w1 are greater than d2 and w2, respectively. The AC inlet 112 includes a conductive terminal (not shown in FIG. 1) and a pin 1121. The pin 1121 has one end connecting to the conductive terminal (not shown in FIG. 1). Another end of the pin 1121 is connected to an internal circuit system 114 of the adapter 11 for electrically connecting the AC inlet 112 to the adapter 11. The engaging element 113 includes a pair of bolts 1131 and openings 1132. In this embodiment, the bolts 1131 are disposed on the surface of the AC inlet 112, and the openings 1132 are disposed in the indentation portion 1111 and correspond to the bolts 1131. Certainly, the positions of the bolts 1131 and openings 1132 can be changed. Since the d1 and w1 of the indentation portion 1111 are greater than the d2 and w2 of the AC inlet 112, when the AC inlet 112 is engaged into the indentation portion 1111 of the housing 111 by the engaging element 113, an airflow channel 12 is formed therebetween. Hence, the heat conduction from the internal circuit system 114 of the adapter 11 to the AC inlet 112 will be insulated by air. Simultaneously, the airflow channel 12 can enhance the heat dissipating effect of the adapter 11 and the AC inlet 112. Therefore, the temperature of the AC inlet 112 can be controlled to comply with the international safety standard more easily.

Figure 2:
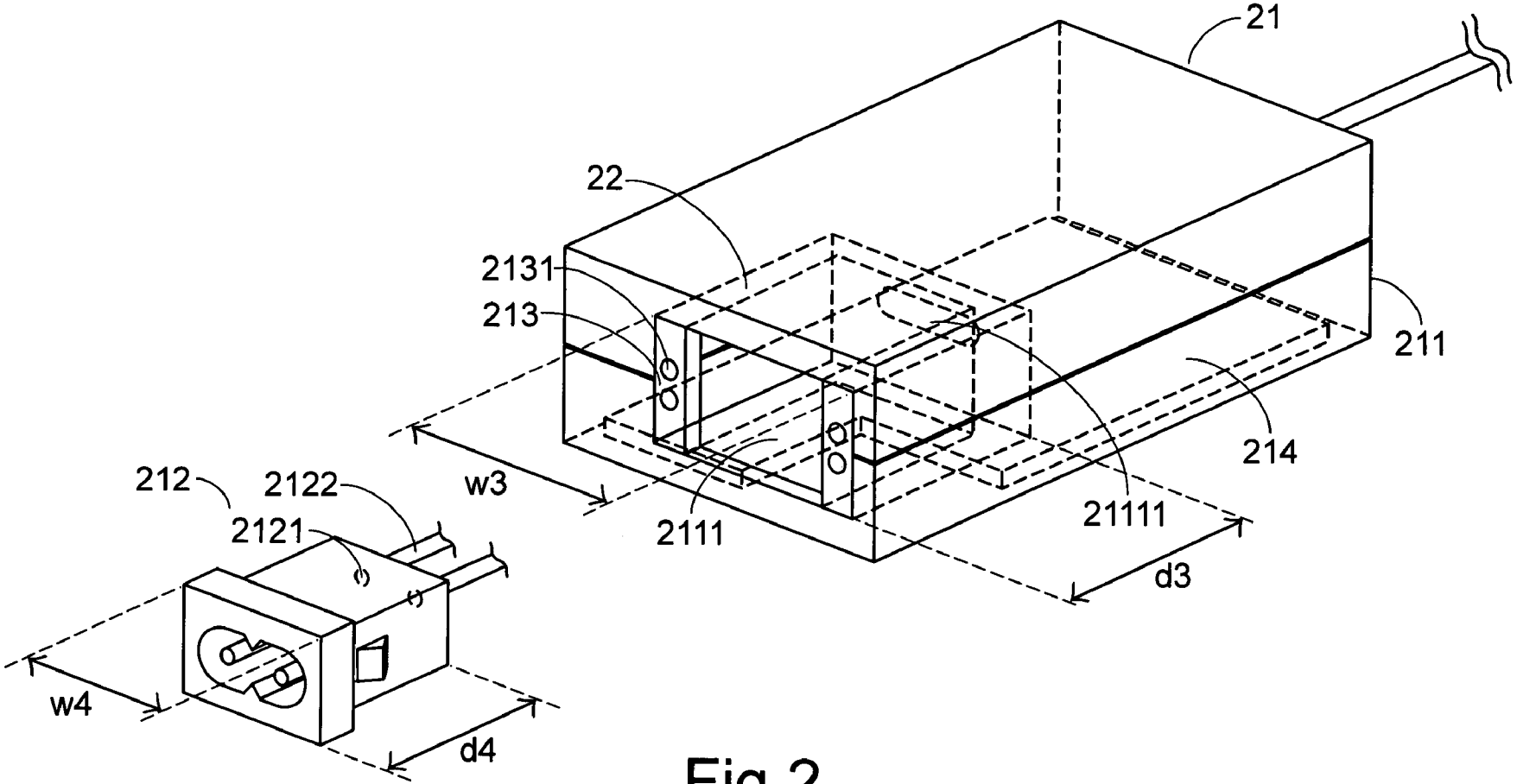
FIG. 2 is a diagram illustrating an electronic apparatus having an AC inlet with heat insulation function according to another preferred embodiment of the present invention.

Please refer to FIG. 2, which is a diagram illustrating an adapter having an AC inlet with heat insulation function according to another preferred embodiment of the present invention. The structure and function of a housing 211, an indentation portion 2111, and an AC inlet 212 are similar to those in FIG. 1 except that the conductive element of the AC inlet 212 and the engaging element. In this embodiment, the conductive element is a power cord 2122. One end of the power cord 2122 is connected to a conductive terminal 2121 of the AC inlet 212 and the other end thereof is passed through an opening 21111 of the indentation portion 2111 to connect an internal circuit system 214, for example a printed circuit board, of the adapter 21, for electrically connecting the AC inlet 212 and the adapter 21. In addition, the engaging element is a protruding block 213 as shown in FIG. 2. The protruding block 213 includes at least one hole 2131 and is disposed in the indentation portion 2111, for engaging the AC inlet 212 into the adapter 21. The depth and the width of the indentation portion 2111 and the AC inlet 212 are d3, w3 and d4, w4, respectively. Since the d3 and w3 of the indentation portion 2111 are greater than the d4 and w4 of the AC inlet 212, when the AC inlet 212 is engaged into the indentation portion 2111 of the housing 211 by the engaging element 213, an airflow channel 22 is formed therebetween. Furthermore, air can further flow between the airflow channel 22 and external environment through the hole 2131 of the protruding block 213. Hence, the heat conduction from the internal circuit system 214 of the adapter 21 to the AC inlet 212 will be insulated by air in the airflow channel 22. Simultaneously, heat dissipating effect of the adapter 21 and the AC inlet 212 can be enhanced by air flowing via the hole 2131.

Figure 3:
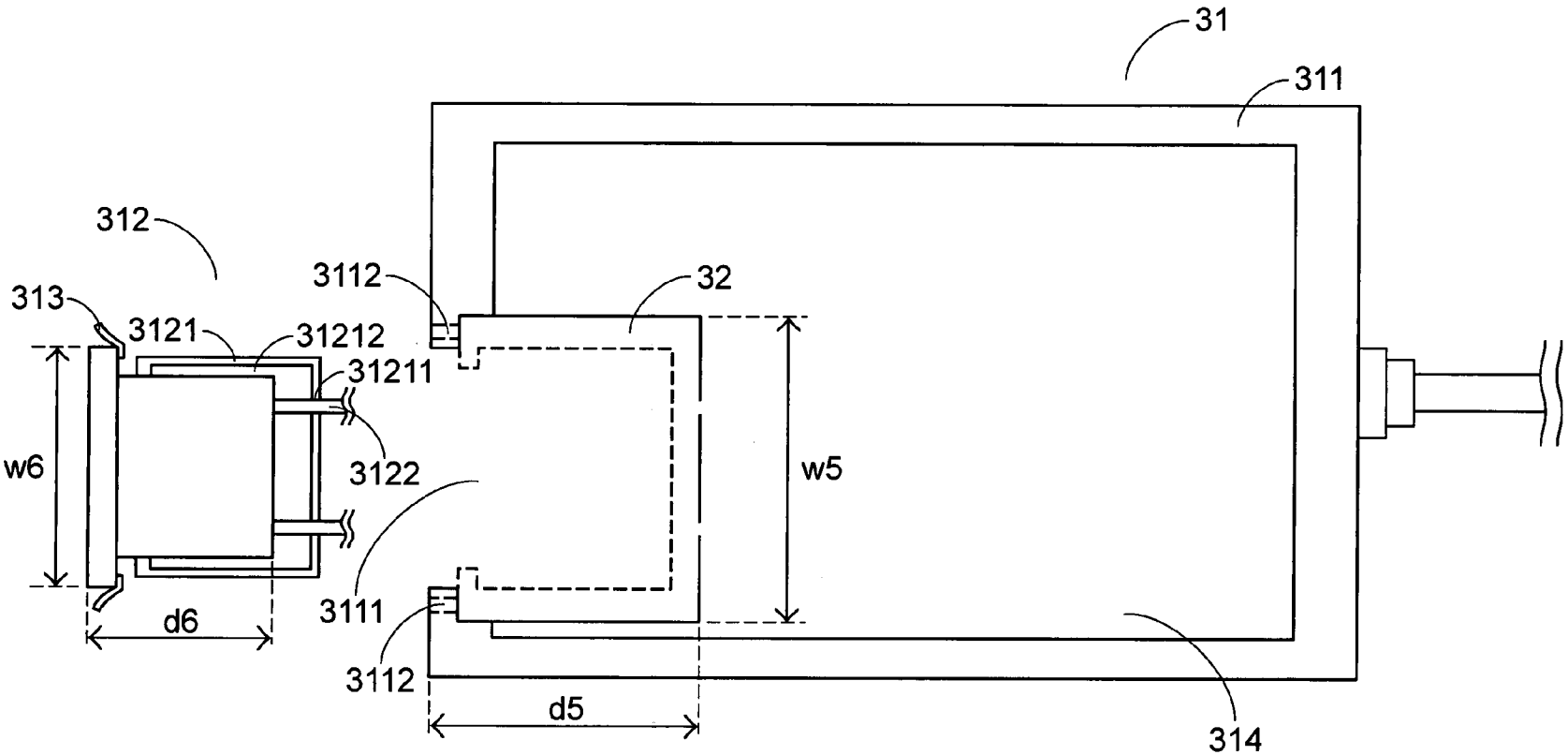
FIG. 3 is a diagram illustrating an electronic apparatus having an AC inlet with heat insulation function according to a further preferred embodiment of the present invention.

Please refer to FIG. 3, which is a diagram illustrating an electronic apparatus having an AC inlet with heat insulation function according to a further preferred embodiment of the present invention. The structure and function of a housing 311, an indentation portion 3111, and an AC inlet 312 are similar to those in FIG. 1 except that the AC inlet 312 further includes an insulating element 3121 and the engaging element is an elastic strip 313. As shown in FIG. 3, the insulating element 3121 wraps around the AC inlet 312 and includes holes 31211 for allowing a conductive element 3122 to pass therethrough to achieve electrical connection between the AC inlet 312 and the adapter 31. There is a space 31212 between the insulating element 3121 and the AC inlet 312 for accommodating an insulating material, for example air, insulating cotton, or Styrofoam (a light, resilient polystyrene plastic). In addition, the elastic strip 313 is disposed on the AC inlet 312 against the indentation portion 3111 when the AC inlet 312 is inserted into the indentation portion 3111 of the housing 311 for fixing the AC inlet 312 into the adapter 31. The depth and the width of the indentation portion 3111 and the AC inlet 312 are d5, w5 and d6, w6, respectively. Similarly, since the d5 and w5 of the indentation portion 3111 are greater than the d6 and w6 of the AC inlet 312, when the AC inlet 312 is engaged into the indentation portion 3111 of the housing 311, an airflow channel 32 is formed therebetween for insulating the heat conduction from an internal circuit system 314 of the adapter 31 to the AC inlet 312. Simultaneously, the insulating material disposed between the insulting element 3121- and the AC inlet 312 can further prevent the heat generated from the adapter 31 from conducting to the AC inlet 312. In addition, the housing 311 can further include a plurality of holes 3112 for allowing air to pass therethrough. Therefore, the heat dissipating effect of the adapter 31 and the AC inlet 312 can be enhanced.

Figure 4:
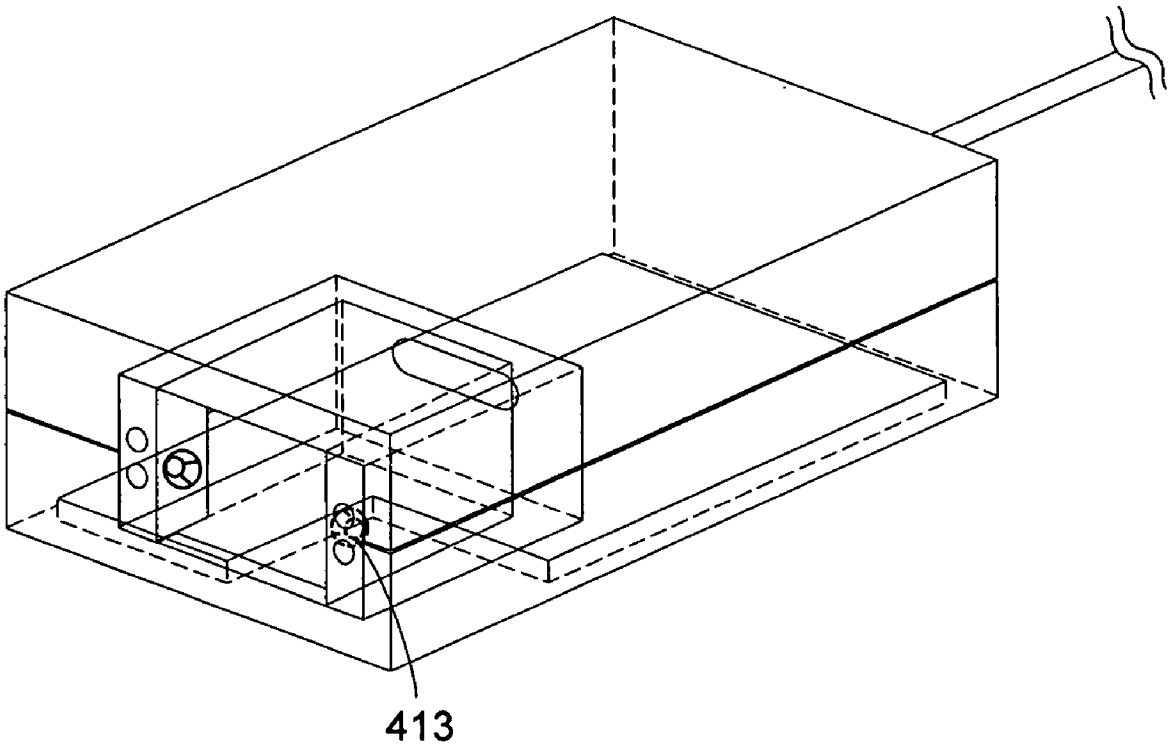
FIG. 4 is a diagram illustrating an electronic apparatus having an AC inlet with heat insulation function according to a further preferred embodiment of the present invention.
Figure 4:
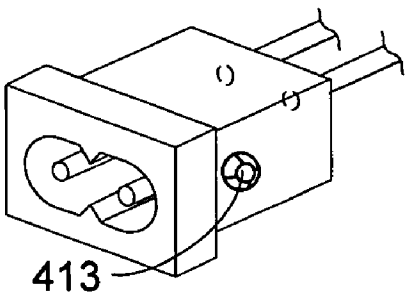

In addition, the shape of the insulating element in FIG. 3 can be cup-shaped or L-shaped. The position of the insulating element also can be changed. Besides the above embodiments, the engaging element can be a buckle 413 (as shown in FIG. 4). Also, the elastic strip 313 shown in FIG. 3 can be replaced with a plastic strip. Certainly, the AC inlet can be fixed into the adapter by screwing or buckling.

To sum up, since the electronic apparatus of the present invention has a greater depth and width indentation portion than the depth and width of the AC inlet, the airflow channel is formed therebetween for allowing air to flow in the airflow channel. The heat generated from the electronic apparatus is blocked by air inside the airflow channel before conducting to the AC inlet. Hence, the temperature influence of the electronic apparatus on the AC inlet can be efficiently reduced, so the temperature of the AC inlet won't be over the international IC 320 standard value. Besides the airflow channel, the insulating element and the insulating material can further insulate the heat generated from the electronic apparatus. In addition, the materials and the elements used in the electronic apparatus of the present invention are easy to get from the market, and are quite cheap. Therefore, the manufacture-cost and time-cost will not be increased.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic apparatus, comprising:

a housing having an indentation portion;

an AC inlet disposed into said indentation portion, wherein said AC inlet comprises a conductive element having one end connected to a conductive terminal of said AC inlet and the other end connected to an internal circuit system within said housing; and an engaging element disposed at said indentation portion and said AC inlet;

wherein the depth and the width of said indentation portion are greater than those of said AC inlet, respectively, thereby forming an airflow channel between said indentation portion and said AC inlet so as to flow air in said airflow channel and wherein said engaging element fixes said AC inlet into said indentation portion of said housing to provide said airflow channel.

2. The electronic apparatus according to claim 1 wherein said conductive element is one of a power cord and a pin.

3. The electronic apparatus according to claim 1 wherein said indention portion comprises an opening for disposing said conductive element.

4. The electronic apparatus according to claim 1 wherein said AC inlet further comprises an insulating element.

5. The electronic apparatus according to claim 4 wherein a space exists between said insulating element and said AC inlet.

6. The electronic apparatus according to claim 5 wherein said space is filled with an insulating material.

7. The electronic apparatus according to claim 1 wherein said engaging element comprises a bolt and an opening correspondingly disposed at said indentation portion and said AC inlet.

8. The electronic apparatus according to claim 1 wherein said engaging element is one selected from a group consisting of a protruding block, an elastic strip, a buckle and a plastic strip.

9. The electronic apparatus according to claim 1 wherein said engaging element further comprises at least one hole for circulating air between said airflow channel and the outside of said housing.

10. The electronic apparatus according to claim 1 wherein said electronic apparatus is a power supply.

11. The electronic apparatus according to claim 1 wherein said electronic apparatus is an adapter.

* * * * *